US009756882B2

(12) United States Patent
Townsend

(10) Patent No.: US 9,756,882 B2
(45) Date of Patent: Sep. 12, 2017

(54) BLANKET TO PROTECT BODY FROM HARSH ENVIRONMENTAL CONDITIONS

(71) Applicant: SERVANT'S HEART OUTFITTERS, L.L.C., Rockwall, TX (US)

(72) Inventor: Kimberly L. Townsend, Heath, TX (US)

(73) Assignee: Servant's Heart Outfitters, L.L.C., Rockwall, TX (US)

( * ) Notice: Subject to any disclaimer, the term of this patent is extended or adjusted under 35 U.S.C. 154(b) by 116 days.

(21) Appl. No.: 14/591,177

(22) Filed: Jan. 7, 2015

(65) Prior Publication Data

US 2016/0192792 A1 Jul. 7, 2016

(51) Int. Cl.

| | |
|---|---|
| ***A41D 13/00*** | (2006.01) |
| ***A47G 9/06*** | (2006.01) |
| ***A41D 13/05*** | (2006.01) |
| ***A41D 13/005*** | (2006.01) |

(52) U.S. Cl.

CPC ..... *A41D 13/0051* (2013.01); *A41D 13/0012* (2013.01); *A41D 13/0543* (2013.01); *A47G 9/066* (2013.01); *A47G 9/068* (2013.01)

(58) Field of Classification Search

CPC ..... A47G 9/02; A47G 9/0207; A47G 9/0215; A47G 9/0223; A47G 9/062; A47G 9/06; A47G 9/064; A47G 9/066; A47G 9/068; A47G 9/08; A47G 9/083; A47C 27/005; A47C 31/113; A41D 13/0051; A41D 13/0012; A41D 13/00; A41D 15/04; A41B 13/06

See application file for complete search history.

(56) References Cited

U.S. PATENT DOCUMENTS

| | | | | |
|---|---|---|---|---|
| 704,276 A | | 7/1902 | Sorensen | |
| 823,469 A | | 6/1906 | Hoenigsberger | |
| 1,678,125 A | * | 7/1928 | Petrescu | A41B 13/06 2/69 |
| 1,706,224 A | * | 3/1929 | Foote | A47G 9/066 2/69 |
| 2,433,626 A | | 12/1947 | Redlin | |
| 2,566,046 A | * | 8/1951 | Weinstein | A41B 13/06 128/870 |

(Continued)

OTHER PUBLICATIONS

Amblemart website; blanket for sale, advertisement downloaded from website on Apr. 9, 2015, 1 page.

(Continued)

*Primary Examiner* — Eric Kurilla

(74) *Attorney, Agent, or Firm* — Haynes and Boone, LLP

(57) ABSTRACT

A blanket that may include a layer of material with trapezoidally shaped notches in two opposite sides of the material. An upper panel of the material may be configured to wrap around a user's upper legs with the user in a sitting position, and a lower panel of the material may be configured to wrap around the user's lower legs. Fasteners removably attach right and left edges of the lower panel together. A method of covering a portion of a user's body with a blanket may include placing the blanket on the user with an upper panel of the blanket over the user's upper legs, and a lower panel of the blanket over the user's lower legs, wrapping left and right edges of the lower panel around the user's lower legs, thereby surrounding the user's lower legs with the lower panel.

7 Claims, 4 Drawing Sheets

(56) References Cited

U.S. PATENT DOCUMENTS 2,712,133 A * 7/1955 Coleman ..... A61G 5/10 2/69
2,980,169 A 4/1961 Campbell
3,597,764 A * 8/1971 Povey ..... A41D 15/04 2/69.5
3,669,107 A 6/1972 Posey
3,739,399 A * 6/1973 Sheahon ..... A41B 13/06 2/69.5
3,882,867 A 5/1975 Moran
4,241,458 A 12/1980 Lesesne
4,261,058 A 4/1981 Buchman
4,363,141 A 12/1982 Doster
4,383,335 A * 5/1983 Slocum ..... A61F 5/4408 2/114
4,514,870 A 5/1985 Tyler, Jr.
4,534,065 A * 8/1985 Comfort ..... A47G 9/066 2/69.5
4,651,346 A 3/1987 Hale
4,764,985 A * 8/1988 Wade ..... A41D 13/1236 2/114
4,833,731 A * 5/1989 Foxman ..... A41D 13/1254 2/47
4,932,077 A * 6/1990 Dobbs ..... A61G 5/10 2/47
4,959,877 A * 10/1990 Covil ..... A47C 21/044 5/423
4,979,250 A * 12/1990 Troncone ..... A41B 13/06 2/69
5,031,247 A 7/1991 Carter
5,044,031 A * 9/1991 Sherwood ..... A61F 7/02 2/69
5,093,947 A * 3/1992 Henegar ..... A47G 9/083 5/413 R
5,150,485 A 9/1992 Maguire
5,283,909 A * 2/1994 Hill ..... A47G 9/066 2/22
5,310,244 A 5/1994 Borgardt
5,454,125 A * 10/1995 Ratkowski ..... A47G 9/066 383/4
5,560,043 A 10/1996 Armstrong
5,604,932 A 2/1997 Lawicki
5,625,895 A 5/1997 Sovereign
5,855,032 A 1/1999 Field
5,897,164 A 4/1999 Kagan et al.
6,175,959 B1 1/2001 Somers
6,223,367 B1 5/2001 French et al.
6,643,870 B2 11/2003 Bertrand
6,757,922 B2 7/2004 Chancey
6,857,649 B2 2/2005 Patton
7,003,825 B1 * 2/2006 Levings ..... A47G 9/066 2/69.5
7,043,782 B2 5/2006 Batchler
7,581,259 B2 9/2009 Thompson
D623,381 S * 9/2010 Flannery ..... D2/728
8,079,099 B1 * 12/2011 Brown ..... A47G 9/066 2/69.5
8,108,949 B2 * 2/2012 Iwashita ..... B32B 27/12 2/272
8,347,420 B2 * 1/2013 Kruszewski ..... B32B 5/024 2/458
8,347,432 B2 1/2013 Schmid et al.
8,516,632 B2 8/2013 Ogundare
8,769,743 B2 * 7/2014 Sanders ..... A47C 27/007 5/500
2002/0129445 A1 9/2002 Deering et al.
2003/0014803 A1 * 1/2003 McCraw ..... A47G 9/0223 2/69
2003/0061659 A1 * 4/2003 Dunlap ..... A47G 9/066 5/485
2005/0097671 A1 5/2005 Wyman
2006/0117455 A1 6/2006 Park et al.
2006/0150293 A1 7/2006 Toso
2006/0174409 A1 * 8/2006 Hermanson ..... A47G 9/0223 5/482
2009/0025118 A1 1/2009 Pothier
2009/0216305 A1 8/2009 Bonner
2010/0115700 A1 5/2010 Pesce
2010/0192271 A1 * 8/2010 Mackiewicz ..... A47G 9/066 2/66
2010/0199402 A1 8/2010 Curtis
2010/0263104 A1 * 10/2010 Flannery ..... A47G 9/066 2/69
2014/0298587 A1 * 10/2014 Sedivy ..... A41B 13/06 5/655

OTHER PUBLICATIONS

Silvert's website; blanket for sale, advertisement downloaded from website on Apr. 9, 2015, 1 page.
Walmart website; blanket for sale, advertisement downloaded from website on Apr. 9, 2015, 1 page.
Ravelry website; blanket for sale, advertisement downloaded from website on Apr. 9, 2015, 1 page.
Black Bear Medical website; blanket for sale, advertisement downloaded from website on Apr. 9, 2015, 1 page.

* cited by examiner

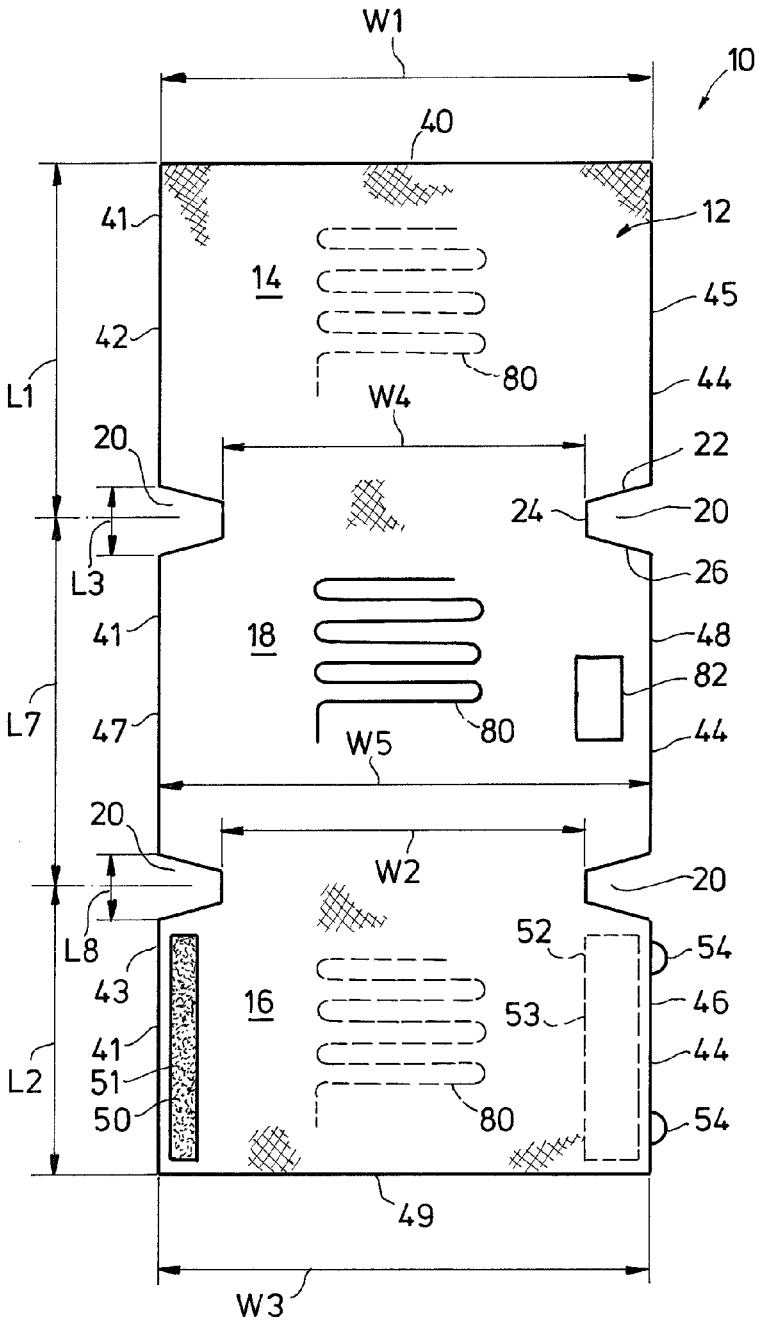
FIG.5
FIG.3
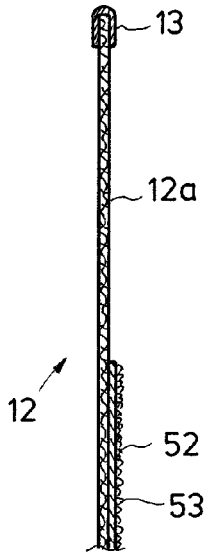
FIG.4
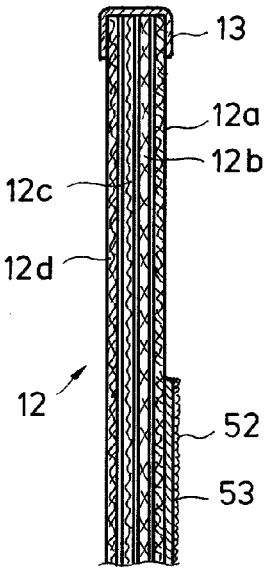

BLANKET TO PROTECT BODY FROM HARSH ENVIRONMENTAL CONDITIONS

BACKGROUND

This disclosure relates generally to items of outer clothing and/or apparel that provide protection to a user from harsh environmental conditions, such as cold temperatures and, in an example described below, more particularly provides a blanket and/or clothing item that wraps around portions of a person's body to keep the body protected from the harsh conditions.

Many outdoor activities require appropriate clothing and/or apparel for people to better enjoy these activities. For example, attending a football game in an open stadium in the winter can be a very unpleasant experience if the participant did not bring proper apparel for the conditions. Proper apparel for some can be much less than proper apparel for someone else. Especially, if that someone else is suffering from an illness that effects his or her body's ability to stay comfortable in even mildly harsh conditions.

Therefore, it will be appreciated that continued improvements in the art of clothing and/or apparel is needed to enable more people to enjoy their desired activities, whether indoors or outdoors.

BRIEF DESCRIPTION OF THE DRAWINGS

FIG. 3 is a representative cross-sectional view of the blanket taken along line 3-3 of FIG. 2.

FIG. 4 is another representative cross-sectional view of the blanket taken along line 4-4 of FIG. 2.

FIG. 5 is another representative top view of the blanket with an additional panel of material.

DETAILED DESCRIPTION

Many people enjoy watching outdoor sports in person instead of at home on a TV. For some, being there is as much a part of the experience of watching the game as the game itself. This may present some challenges when the weather conditions are much less than ideal, such as wind, rain, cold temperatures, hot temperatures, or any combinations of these. Some people may be able to handle these harsh conditions better than others. For example, people who tolerate the cold weather conditions better than most may be referred to as "hot-natured" and they tend to wear less clothing and/or apparel during the games without their comfort being effected past their tolerance point. However, others, who do not tolerate cold weather conditions very well, may be referred to as "cold-natured" and they tend to wear more clothing and/or apparel during the games (or other activities) to prevent their comfort from being affected past their tolerance level.

Other people may have, at some point in their lives, enjoyed a much higher tolerance to the harsh weather conditions than they do now. This may be caused by many factors, such as growing old and/or reduced blood circulation, but many people lose this tolerance due to illnesses.

One possible illness may be Amyotrophic Lateral Sclerosis (ALS), often referred to as "Lou Gehrig's Disease."

This is a progressive neurodegenerative disease that affects nerve cells in the brain and the spinal cord. Motor neurons reach from the brain to the spinal cord and from the spinal cord to the muscles throughout the body. With ALS, the progressive degeneration of the motor neurons in a patient's brain eventually leads to loss of the ability of the brain to initiate and control muscle movement. Some people with ALS, develop reactions to the cold that cause uncontrollable spasms of the legs and/or arms, which can cause them great discomfort and may prevent the person from enjoying activities that trigger these reactions.

The current disclosure provides a blanket that can allow a user to enjoy more activities without experiencing the negative reactions due to cold, heat, precipitation, wind, etc.

Figure 1:
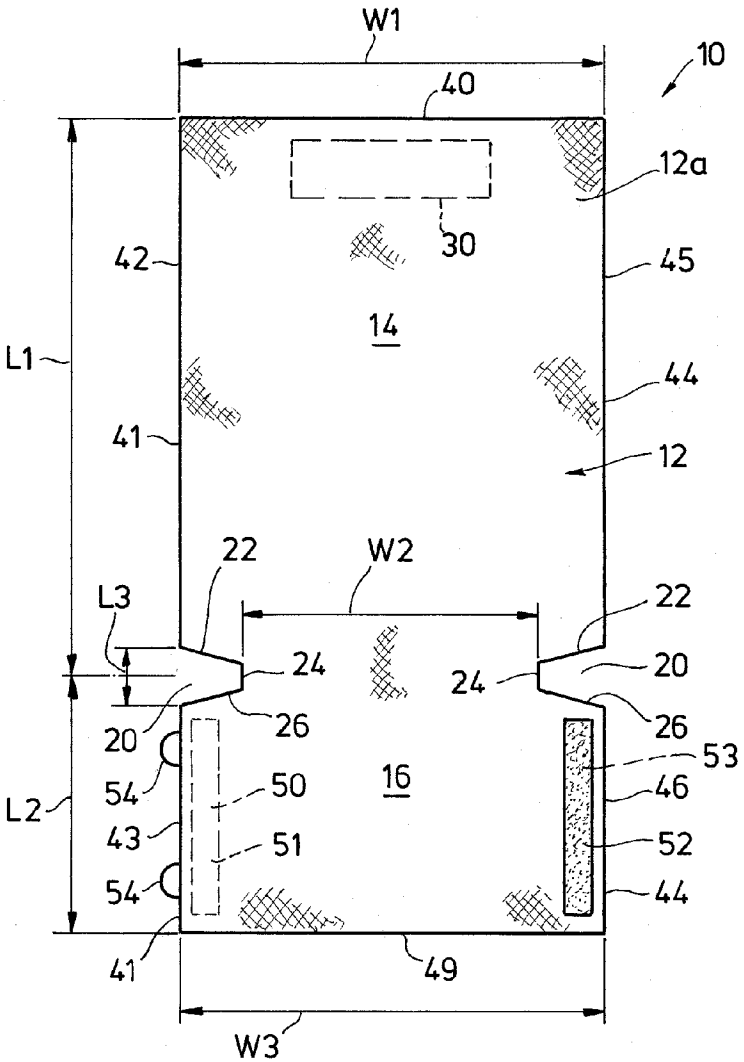
FIG. 1 is a representative top view of a blanket which can embody principles of this disclosure.

Representatively illustrated in FIG. 1 is a blanket 10 which can incorporate a material 12 with one or more panels and an associated method that embodies the principles of this disclosure. The blanket 10 may be used to restrict transfer of heat from the user to a surrounding environment, or from the surrounding environment to the user.

FIG. 1 shows a blanket 10 made from the material 12 that is generally configured as a rectangle with upper and lower panels 14, 16, respectively. The rectangular material 12 is shown with a top edge 40, a bottom edge 49, a left edge 41 and a right edge 44. The left and right edges 41, 44 may be divided into upper and lower portions by notches 20. The upper portion 42 of the left edge 41 is above the left notch 20, with the lower portion 43 of the left edge 41 being below the left notch 20. The upper portion 45 of the right edge 44 is above the right notch 20, with the lower portion 46 of the right edge 44 being below the right notch 20.

It should be clearly understood that the material 12 may have fewer or more panels than the panels 14, 16. For example, the material 12 may include an upper panel 14, a middle panel 18, and the lower panel 16 (see FIG. 5). Therefore, any number of panels may be included in the blanket 10.

It should also be clearly understood that it is not necessary for the material 12 to be generally rectangular. The material 12 may be any shape that is suitable for the blanket 10 (e.g., square, T-shaped, inverted T-shape, I-shaped, Oval-shaped, etc.). FIG. 1 shows that width W1 of the upper panel 14 is substantially the same as width W3 of the lower panel 16. As used herein, "substantially the same width" refers to widths (such as W1 and W3) being the same width with a tolerance of +/−one inch. Therefore, for example, if W1 is equal to W3+(plus) one inch, or if W1 is equal to W3−(minus) one inch, then both widths W1 and W3 may be referred to as being "substantially the same width."

However, width W1 may be substantially larger than width W3, or width W1 may be substantially smaller than width W3 in keeping with the principles of this disclosure. As used herein "substantially larger than" refers to a width being more than one inch larger than another width to which it is being compared. As used herein "substantially smaller than" refers to a width being more than one inch smaller than another width to which it is being compared.

Figure 6B:
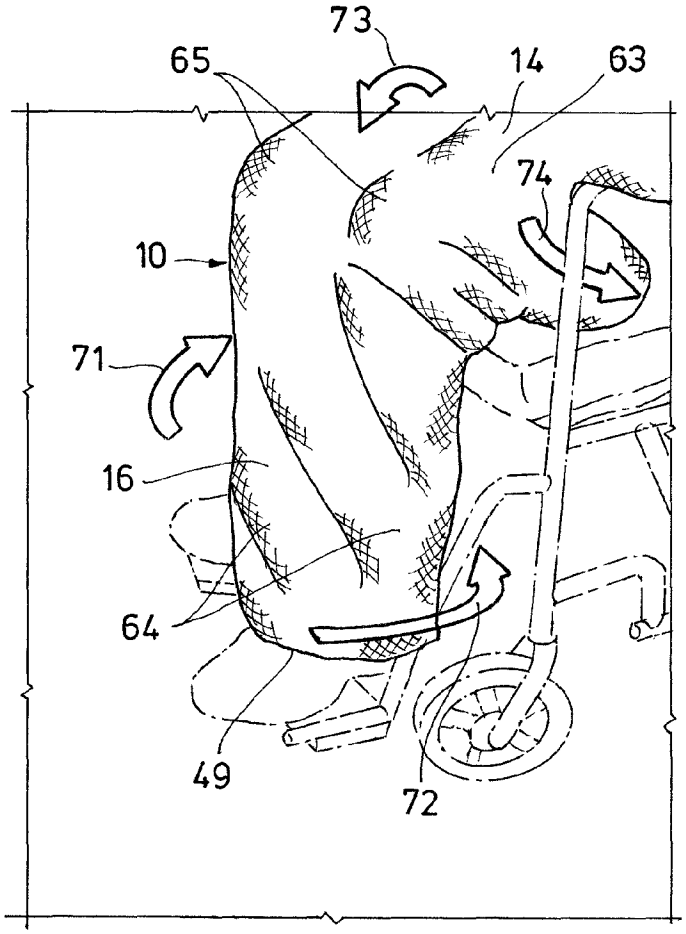
FIGS. 6*a-d* are representative perspective views of the blanket at various stages of installation on a user.

The upper panel 14 can be used to wrap at least partially around the upper legs 63 (or thighs) of the user, with the lower panel 16 being used to wrap around the lower legs 64 (or calves) of the user 61 (see FIG. 6*b*). The upper panel 14 has a width of W1 and a length of L1, with the material at each notch 20 removed. The lower panel 16 has a width of W3 and a length of L2, with the material at each notch 20 removed. The width of the blanket at the notches 20 is W2. The widths W1 and W3 can be substantially the same, with the width W2 being substantially less than widths W1 and W3. These widths can be selected based on the size of the user to be covered by the blanket 10.

However, it is not necessary that widths W1 and W3 be substantially the same. For example, width W1 may be substantially greater than width W3 to accommodate a user with larger upper legs 63.

Figure 2:
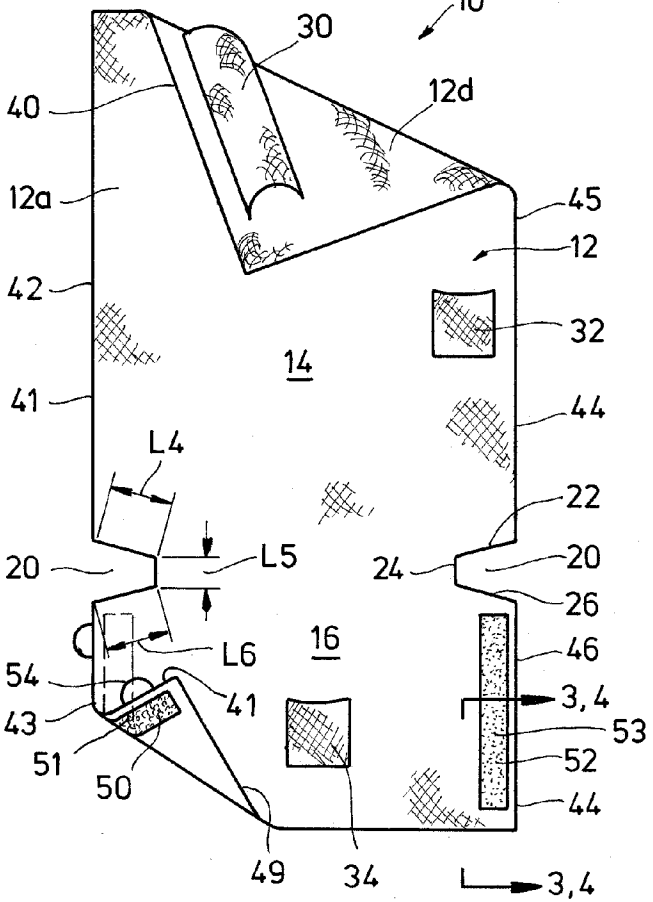
FIG. 2 is another representative top view of the blanket with two corners folded back.

The upper panel 14 can include one or more hand-warmer pockets 30 attached to an inner layer 12*d* of the blanket (see FIG. 2). Dashed lines in FIG. 1 indicates one hand-warmer pocket 30 that can be used to receive both hands of the user when the blanket is placed over the user's legs. The hand-warmer pocket 30 can be made from any suitable material, such as a fleece material, a waterproof material, an insulating material, etc. It can be attached (either fixedly or removably) to the inner layer 12*d* via sewing, hook and loop fasteners, buttons and button holes, zippers, etc. Additionally, the hand-warmer pocket may include hook fasteners that attach to the fabric of the inner layer 12*d*, without requiring loop fasteners to be installed on the inner layer 12*d* for engaging the hook fasteners.

As used herein, hook and loop fasteners refer to a fastening means that uses a strip of hook members 51 and a strip of loop members 53. When the hook members 51 are pressed into or against the loop members 53, at least some of the hook members 51 hook into at least some of the loop members 53, thereby resisting removal of the hook members 51 from the loop members 53. If a sufficient separation force is applied to the hook and loop members 51, 53, then the hook members 51 may be pulled out of the loop members 53, thereby releasing the hook members 51 from the loop members 53. VELCRO® is a type of hook and loop fastener that can be used with the blanket of the current disclosure.

Fasteners 50, 52 can be used to removably attach the left edge 43 of the lower panel 16 to the right edge 46 of the lower panel 16 after the lower panel 16 is wrapped around the user's lower legs 64. The fasteners 50, 52 can be any type that allows the fastener 50 and mating fastener 52 to be removably attached to each other, such as hook and loop fasteners, magnets, a zipper, buttons and button holes, etc.

The fastener 50 can be installed proximate and parallel to the left edge 43, with the mating fastener 52 installed proximate and parallel to the right edge 46. When the fastener 50 is engaged behind the user's lower legs 64 with the mating fastener 52, then the lower panel 16 will surround the user's lower legs 64 insulating them from environmental conditions. There can be an overlap of the material 12 of the lower panel 16 when the fastener 50 is attached to the mating fastener 52. When separation of the fasteners 50, 52 is desired, loops 54 can be used (by the user and/or someone else) to apply sufficient force to separate the fastener 50 from the mating fastener 52.

The fasteners 50, 52 can be hook and loop fasteners with a strip of hook members 51 as one of the fasteners 50, 52, and a strip of loop members 53 as the other one of the fasteners 50, 52. In this configuration, one of the fasteners 50, 52 can be installed on the inside of the blanket 10, with the other one installed on the outside of the blanket 10. Therefore, when the lower panel 16 is wrapped around the user's lower legs 64, the fasteners 50, 52 can engage each other.

The fasteners 50, 52 can be oppositely oriented magnets that attract each other when they are placed close together. In this configuration, fastener 50 may be one or more magnets sewn to the blanket along the edge 43, and fastener 52 may be one or more oppositely oriented magnets sewn to the blanket along the edge 46. When the lower panel 16 is wrapped around the user's lower legs 64, the fasteners 50, 52 attract each other and produce a coupling force that resists separation of the fasteners 50, 52.

The fasteners 50, 52 can be two halves of a zipper where the fasteners 50, 52 are engaged when the zipper is zipped together. The fasteners 50, 52 can also be buttons and button holes where the fasteners 50, 52 are engaged when the buttons are inserted into the button holes. The loops 54 are not required for any of these configurations of fasteners 50, 52, but the loops 54 may be preferred when using some fasteners, such as hook and loop fasteners, and magnets. It can clearly be seen that many types of fasteners may be used in keeping with the principles of the current disclosure.

Each notch 20 can form a void in the material 12. Each notch 20 can have sides 22 and 26 which extend inward from the edge 41 or 44 to a top 24, with the top 24 being generally parallel to the respective edge 41, 44. The notch 20 may be shaped like a flat top triangle, with the lengths L4, L6 of sides 22, 26, respectively, being substantially the same length, and the length L5 of the top 24 being substantially less than the lengths L4, L6. Also, each side 22, 26 angles toward each other as they extend inwardly from the edge 41 or 44 to the top 24.

However, it is not necessary that the notch 20 be shaped like a flat top triangle. For example, the notch 20 can be shaped like a rectangle, with each side 22, 26 being parallel to each other as they extend inwardly to the top 24. Alternatively, the notch 20 can be trapezoidally shaped with the lengths L4, L6 of respective sides 22, 26 being different lengths. This can be the case if the width W1 of the upper panel 14 is substantially larger than the width W3 of the lower panel 16 (configuration not shown). This configuration can have length L4 of side 22 substantially longer (or larger) than length L6 of side 26.

These shapes refer to the shape of the notch 20 when the blanket is laid in a single plane as viewed in FIG. 1 The notches 20 may not necessarily resemble a triangle, a rectangle, a trapezoid, etc. when the blanket is positioned on the user, since the material 12 will be shaped around the user causing variations in the gap formed by the notches 20 in the left and right edges 41, 44, thereby potentially changing the shape of the notches 20.

Referring now to FIG. 2, the top right corner and the lower left corner of the blanket 10 are folded over to reveal items that can be attached to the inner layer 12*d* (see FIG. 4). The hand-warmer 30 mentioned above is shown attached to the inner layer 12*d* proximate the upper end of the upper panel 14. This hand-warmer 30 should be positioned such that the user's hands 68 (see FIG. 6*c*) will comfortably rest in the hand-warmer 30 when in use. The fastener 50 is shown attached to the inner layer 12*d* proximate the left edge 43.

FIG. 2 also indicates other items that may be attached to the blanket 10, such as pockets 32, 34, which can be attached to the outer layer 12*a*. These pockets 32, 34 can be used to store personal items, such as cell phones, keys, tissues, etc. These pockets 32, 34 (or other pockets) may also be attached to the inner layer 12*d*, if it is preferred that the pockets 32, 34 are not exposed to the environmental conditions, such as to store a battery, cell phone, papers, etc.

FIGS. 3 and 4 show cross-sectional views of the material 12. These figures illustrate possible configurations of the material 12. FIG. 3 shows material 12 with a single material layer 12*a*. FIG. 4 shows the material 12 with up to four layers. It should be clearly understood that any number of layers can be used to make up the material 12. The examples shown in FIGS. 3 and 4 are only two possible configurations of the material 12.

Material 12 can be made from any suitable material and/or any combination of suitable materials, such as a waterproof material, a windproof material, a quilted material, a heating material/element, a fleece material, etc. Examples of waterproof materials can be materials like GORETEX® or SUPPLEX®, materials used to make dry suits for diving, and 100% NYLON® material. As used herein, "waterproof material" refers to a material that prevents (or at least significantly restricts) water penetration through the material. Therefore, "waterproof material" also refers to water resistant materials, which do not completely prevent water penetration.

Examples of windproof materials can be parachute materials, and materials used to make wind breaker jackets and wind pants. As used herein, "windproof material" refers to a material that prevents (or at least significantly restricts) penetration of wind through the material. Therefore, "windproof material" also refers to wind resistant materials, which do not completely prevent wind penetration.

Examples of a heating material/element can be a fabric with an integral heating element, similar to electric blankets for bedding. The heating material/element can also be similar to the battery powered heating elements used in the MOBILE WARMING® clothing.

Examples of the fleece material can be a 100% polyester fleece material, wool, polar fleece, and other materials that are comfortable to the skin and provide enhanced protection from harsh temperature conditions.

Examples of the insulation material can be a Biaxially-oriented polyethylene terephthalate (BoPET), which is a polyester film made from stretched polyethylene terephthalate (PET). Some BoPET materials are MYLAR®, MELINEX® and HOSTAPHAN®. As used herein, "insulation material" refers to a material(s) that restrict flow of thermal energy through the material.

With these materials in mind, FIG. 4 shows a possible multi-layer configuration of material 12. Preferably, the first or outer layer 12*a* can be made from a waterproof and/or windproof material. This outer layer 12*a* can provide a first line of defense against harsh environmental conditions and help prevent fouling of any inner layers 12*b-d*. The second layer 12*b* can be made from a quilted polyester material that provides additional air pockets between the outer and other inner layers to aid in restricting heat flow through the blanket 10. The third layer 12*c* can be made from a heating material/element to provide active heating if the blanket 10 is not enough to keep the user warm. The heating material can include distributed heating elements 80 (see FIG. 5) attached to a material. The heating elements can be electrically powered by a battery 82 (see FIG. 5) and/or a direct connection to a power source (not shown). The fourth layer or inner layer 12*d* can be made from a fleece material which is comfortable to the touch and provides enhanced heat energy retention.

However, it is not necessary that the materials described above regarding FIG. 4 be used for the layers 12*a-d*. Any of these materials can be used to make any of the layers 12*a-d*, as well as having more or less layers than layers 12*a-d*. For example, outer layer 12*a* can be made from a fleece material with second layer 12*b* being made from a waterproof material. This configuration can be beneficial if the temperatures are hot and it is desirable to keep the outer layer 12*a* wet while preventing the water from penetrating the remaining layers. In this configuration, the heating material/element may not be desirable. Additionally, the single layer 12*a* of FIG. 3 can be made from any of the materials described above.

Please note that a border material 13, shown in FIGS. 3, 4, can be attached (e.g. sewn) around the perimeter of the blanket 10 to provide a finished look to the blanket.

Referring now to FIG. 5, the blanket 10 is shown with three panels 14, 16, and 18, of the material 12. The upper panel 14 can be used to wrap at least partially around the shoulders and torso of the user. A pair of notches 20 are formed between the upper panel 14 and the middle panel 18, with another pair of notches 20 formed between the middle panel 18 and the lower panel 16.

The widths W1, W3, W5 of the different panels 14, 16, 18 can be the same or different. The width W1 can be larger than the widths W5 and W3, if the user prefers more coverage of his/hers shoulders and torso. This may be referred to as a T-shape, similar to a T-shape with the blanket 10 in FIG. 1 if the upper panel 14 was wider than the lower panel 16. If widths W1 and W3 are the same, but width W5 is smaller than widths W1 and W3, then this can be referred to as an I-shape. An inverted T-shape can be made if the widths W1, W5 are the same size with width W3 being larger than widths W1, W5. It should be clearly understood that any variations of widths W1-W5 can be made in keeping with the principles of this present disclosure.

FIG. 5 also shows possible positions of heating elements 80 in the blanket 10. The heating elements 80 can be in any of the layers 12*a-d* of the material 12. A possible location of a battery 82 is shown, if the battery 82 is used for the power source to power the heating elements. Alternatively, or in addition to, a power cord connection (not shown) may be used to supply necessary power to the heating elements 80. This power cord connection can connect the heating elements 80 to an external battery source, and/or utility power.

FIG. 5 also shows a fastener 52 that is wider than the fastener 52 shown in FIG. 1. This may be beneficial to allow more flexibility in alignment of the fastener 50 with the fastener 52.

It should be clearly understood that any of the features of the blanket 10 shown in FIGS. 1, 2, 5 can be used in any of the embodiments of blanket 10 shown in these figures. None of these features, such as heating elements 80, battery 82, extra pockets, wider fasteners, etc. are mutually exclusive to each other.

Figure 6A:
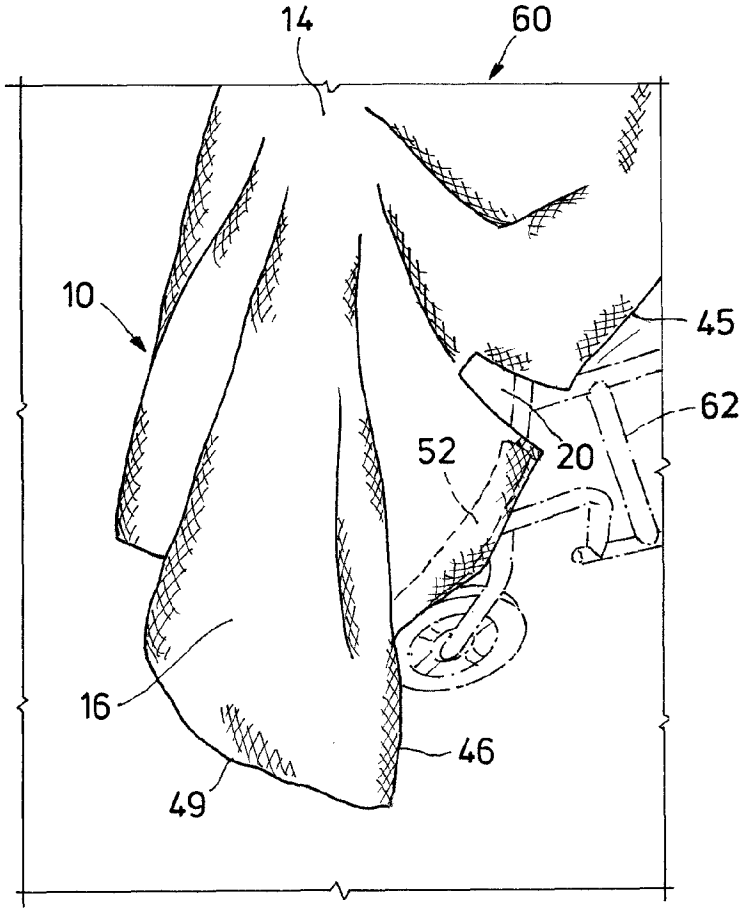
Figure 6D:
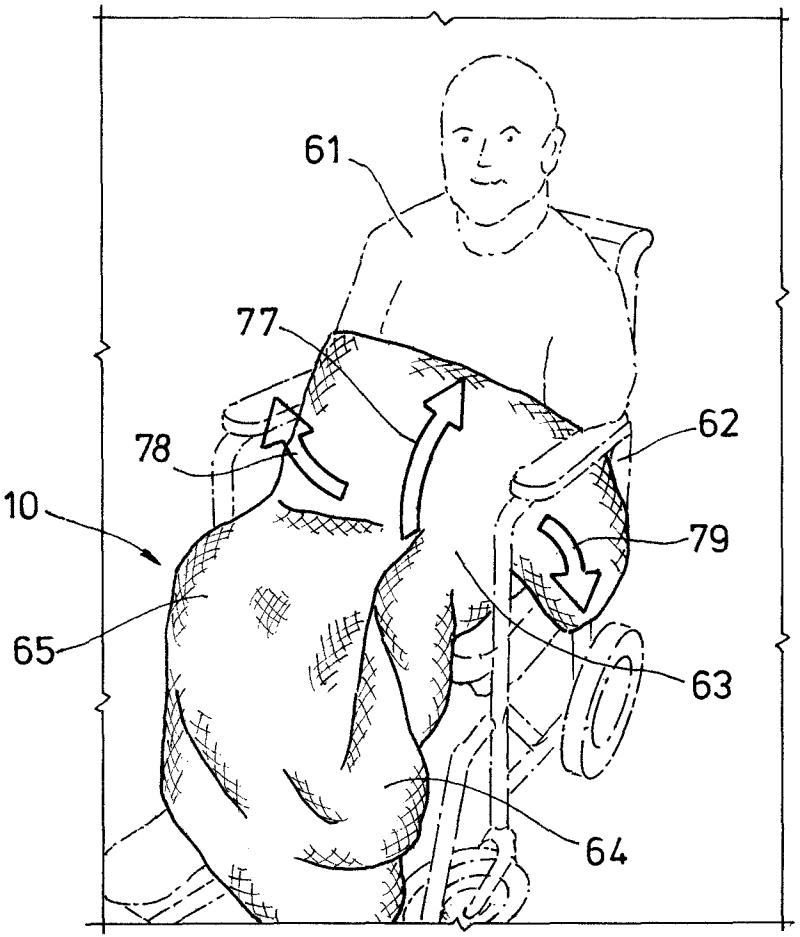

Referring now to FIGS. 6*a*-6*d*, a method 60 of putting the blanket 10 on a user 61 is described. When the blanket 10 is first placed on the user 61, the user 61 will be sitting in a seat 62, where the seat 62 can be a chair, a couch, a wheelchair, a vehicle seat, boat seat, a stadium seat, etc. The blanket can then be laid over the lap of the user 61, with the upper panel 14 laid over the user's upper legs 63 (the "lap" area), and the lower panel 16 draped in front of the user's lower legs 64, with the notches 20 positioned proximate the user's knees 65 as seen in FIG. 6*a*.

Figure 6C:
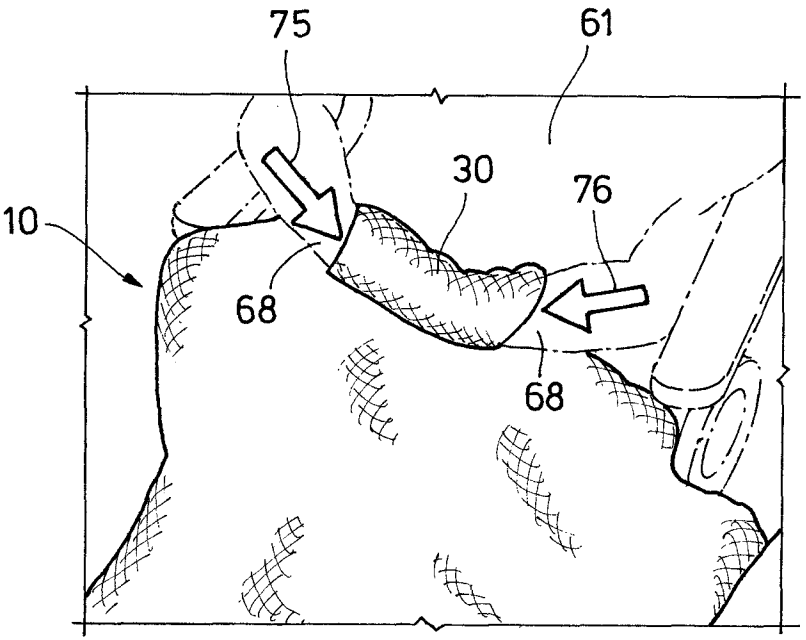

In FIG. 6*b*, arrows 71, 72 indicate the left edge 43 (not shown) and the right edge 46 of the lower panel 16 being wrapped around the user's lower legs 64. The fasteners 50, 52 are then fastened together behind the user's lower legs 64 to provide a snug fit. The arrows 73, 74 indicate the left edge 42 (not shown) and right edge 45 of the upper panel 14 being tucked underneath the user's upper legs 63. In FIG. 6*c*, a top portion of the upper panel 14 is folded back to reveal the hand-warmer 30, into which the user's hands 68 can be inserted as indicated by arrows 75, 76. Then the top portion can be folded back against the user's chest (indicated by arrow 77) and the left and right edges of the upper portion of the upper panel 14 can be tucked under the user's buttocks as indicated by arrows 78, 79. The user is now ready to enjoy the desired activities with an increased probability that he/she will remain warm.

If the certain embodiment of the blanket 10 shown in FIG. 5 is used for the method shown in FIGS. 6*a*-6*d*, then the method can be modified to wrap the lower panel 14 around the lower legs 64, wrap the middle panel 18 over the upper legs 63, install the user's hands 68 in the hand-warmer 30 (if provided), and then wrap the upper portion 14 around the upper body of the user 61.

It is to be understood that the certain embodiments illustrated in the drawings are depicted and described merely as examples of useful applications of the principles of the disclosure, which are not limited to any specific details of these certain embodiments.

In the above description of the representative examples of the disclosure, directional terms, such as "above," "below," "upper," "lower," etc., are used for convenience in referring to the accompanying drawings. In general, "above," "upper," "upward" and similar terms refer to a direction toward the head of the user, and "below," "lower," "downward" and similar terms refer to a direction away from the head of the user. In general, "left" and "right," refer to an orientation as viewed in the figures when referring to the blanket 10 and/or its parts. However, "left" and "right," when used in reference to the user refer to an orientation normally given to body parts of the user, such as left and right legs, left and right buttocks, left and right sides. Therefore, with the figures showing a perspective of one looking at the user in the sitting position, then the "left" edge of the blanket would be tucked under the "right" side of the user. In general, "inner" and similar terms refer to a direction toward the user, and "outer" and similar terms refer to a direction away from the user.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A blanket, comprising:

a material with a top edge, a bottom edge, a left edge and a right edge, wherein the material includes an outer layer, an intermediate layer, and an inner layer;

a trapezoidally shaped notch extending inwardly from each of the left and right edges, the trapezoidally shaped notches being generally shaped as a triangle with a flat top, wherein the notches are voids in the material, and no other material is connected across the voids between sides of the trapezoidally shaped notches;

an upper panel of the material is above the notches, wherein the upper panel is configured to be wrapped at least partially around a user's upper legs with the user in a sitting position; a lower panel of the material is below the notches, wherein the lower panel is configured to be wrapped at least partially around the user's lower legs with the user in the sitting position;

and fasteners that removably attach the right and left edges of the lower panel together, wherein the fasteners include a strip of hook members and a strip of loop members with each strip including a long side and a short side, with one of the strips fixedly attached parallel and proximate to the right edge of the lower panel, wherein the long side of the one of the strips is parallel to the right edge of the lower panel, and the other one of the strips fixedly attached parallel and proximate to the left edge of the lower panel, wherein the long side of the other one of the strips is parallel to the left edge of the lower panel, and wherein the upper panel has a largest width measured transversely across the blanket and the lower panel has a largest width measured transversely across the blanket, the largest width of the upper panel being substantially greater than the largest width of the lower panel.

2. The blanket of claim 1, further comprising at least one hand-warmer pocket attached to the inner layer of the upper panel.

3. The blanket of claim 1, wherein a storage pocket is attached to the outer layer.

4. The blanket of claim 1, wherein the outer layer is a waterproof material, the intermediate layer is a thermal insulating material, and the inner layer is a fleece material.

5. The blanket of claim 4, wherein the waterproof material is nylon.

6. The blanket of claim 4, wherein the thermal insulating material is biaxially-oriented polyethylene terephthalate.

7. The blanket of claim 1, wherein the sides of the trapezoidally shaped notches are substantially 5 inches in length, with the flat top of each notch having a length of substantially 1 inch.

* * * * *